US009568214B2

(12) United States Patent
Sharpe et al.

(10) Patent No.: US 9,568,214 B2
(45) **Date of Patent: *Feb. 14, 2017**

(54) SYSTEMS AND METHODS FOR HEATING WATER USING BIOFUEL

(71) Applicant: Greenwood Clean Energy, Inc., Redmond, WA (US)

(72) Inventors: David S. Sharpe, Bellevue, WA (US); Michael R. Kuehner, Snoqualmie, WA (US); Douglas S. Denton, Kirkland, WA (US); Bryan J. Louviere, Covington, WA (US)

(73) Assignee: GREENWOOD CLEAN ENERGY, INC., Bellevue, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/835,563

(22) Filed: Aug. 25, 2015

(65) Prior Publication Data

US 2015/0362216 A1 Dec. 17, 2015

Related U.S. Application Data

(63) Continuation of application No. 13/205,503, filed on Aug. 8, 2011, now Pat. No. 9,115,900.

(Continued)

(51) Int. Cl.

*F24C 1/00* (2006.01)
*F24H 9/20* (2006.01)

(Continued)

(52) U.S. Cl.

CPC ..... *F24H 9/2035* (2013.01); *F23G 5/50* (2013.01); *F24B 1/1881* (2013.01);

(Continued)

(58) Field of Classification Search

CPC ..... F24B 1/1881; F24B 13/004; F23G 5/50; F23G 2207/30; F24C 1/00

(Continued)

(56) References Cited

U.S. PATENT DOCUMENTS 2,286,688 A 6/1942 Roth
3,336,716 A 8/1967 Scheppers (Continued)

FOREIGN PATENT DOCUMENTS

DK WO03025459 A1 3/2003
KR 1020040102602 A 12/2004
KR 1020100066319 A 6/2010

OTHER PUBLICATIONS

PCT International Searching Authority, PCT/US2011/046973, International Search Report, Apr. 6, 2012, 8 pages.

(Continued)

*Primary Examiner* — Gregory Huson
*Assistant Examiner* — Nikhil Mashruwala
(74) *Attorney, Agent, or Firm* — Michael R. Schacht; Schacht Law Office, Inc.

(57) ABSTRACT

The present invention may be embodied as a biofuel heating system comprising a controller for operating a fan based on a load operating parameter such that air flows along a flow path extending through a combustion chamber, through a burn-out port, through a burn-out chamber, through a heat exchange port, through a heat exchange chamber, and out of an exhaust port. A heat exchange system transfers heat energy from air flowing through the heat exchange chamber to a working fluid. The controller operates in a char mode based at least in part on the load operating parameter, and the biofuel remains within the combustion zone during the char mode.

14 Claims, 11 Drawing Sheets

Related U.S. Application Data

(60) Provisional application No. 61/371,288, filed on Aug. 6, 2010.

(51) Int. Cl.

| | |
|---|---|
| ***F23G 5/50*** | (2006.01) |
| ***F24B 1/188*** | (2006.01) |
| ***F24B 13/00*** | (2006.01) |
| ***F24H 1/00*** | (2006.01) |
| ***F24H 1/08*** | (2006.01) |

(52) U.S. Cl.
CPC ..... *F24B 13/004* (2013.01); *F24H 1/0027* (2013.01); *F24H 1/08* (2013.01); *F23G 2207/30* (2013.01); *F23G 2209/26* (2013.01)

(58) Field of Classification Search
USPC .... 126/58, 112, 73; 110/204, 210, 214, 297; 431/10, 12
See application file for complete search history.

(56) References Cited

U.S. PATENT DOCUMENTS

| | | | |
|---|---|---|---|
| 4,303,198 | A | 12/1981 | Dulac |
| 4,319,556 | A | 3/1982 | Schwartz et al. |
| 4,344,411 | A | 8/1982 | Dearborn |
| 4,388,692 | A | 6/1983 | Jones et al. |
| 4,461,242 | A | 7/1984 | Black |
| 4,516,534 | A | 5/1985 | Jahier |
| 4,549,526 | A | 10/1985 | Lunde |
| 4,556,044 | A | 12/1985 | Barsness et al. |
| 4,612,878 | A | 9/1986 | Schnurer |
| 4,724,798 | A | 2/1988 | Alspaugh |
| 4,831,941 | A | 5/1989 | Childs |
| 4,838,183 | A | 6/1989 | Tsaveras et al. |
| 5,029,534 | A | 7/1991 | Childs |
| 5,052,310 | A | 10/1991 | Goff et al. |
| 5,590,832 | A | 1/1997 | Fiedrich |
| 5,893,358 | A | 4/1999 | Whitfield |
| 6,029,648 | A | 2/2000 | Willis |
| 7,438,024 | B2 | 10/2008 | Bast |
| 8,302,545 | B2 | 11/2012 | Swanson et al. |
| 9,115,900 | B2 | 8/2015 | Sharpe et al. |
| 2004/0206485 | A1 | 10/2004 | Ferraro |
| 2006/0196400 | A1 | 9/2006 | Martin et al. |
| 2007/0100502 | A1 | 5/2007 | Rennie et al. |
| 2007/0125283 | A1 | 6/2007 | Mercx et al. |
| 2008/0083356 | A1 | 4/2008 | Payne et al. |
| 2008/0110380 | A1 | 5/2008 | Gauthier et al. |
| 2009/0173259 | A1 | 7/2009 | Walborn |
| 2009/0183693 | A1 | 7/2009 | Furman |
| 2009/0199747 | A1 | 8/2009 | Laskowski et al. |
| 2012/0222410 | A1* | 9/2012 | Maly ..... B01D 53/10 60/297 |
| 2012/0244479 | A1* | 9/2012 | Zhou ..... F23C 6/045 431/2 |

OTHER PUBLICATIONS

Seton Wood Boilers, Web site http://replay.web.archive.org/20050403154847/http://rohor.com/page7.html, Apr. 3, 2005, 1 page.

Seton Wood Boilers, Web site http://replay.web.archive.org/20050420015117/http://www.rohor.com/, Apr. 20, 2005, 3 pages.

* cited by examiner 56
58
84
STACK
130
44
FSS
FAN
170
146
230
24
34
PS2
162
TS4
HEAT EXCH.
COND. SYSTEM
LOAD
PS1
160
148
TS5
232
32
OS
TS3
CB
120
TS7
152
172
144
82
42
20
36
TS2
142
30
74
80
72
70
134
54
OFD
TS1
140
40
50
22
TS6
150
52
68
66
60
132
64
UFD
62

SYSTEMS AND METHODS FOR HEATING WATER USING BIOFUEL

RELATED APPLICATIONS

This application, U.S. patent application Ser. No. 14/835,563 filed Aug. 25, 2015, is a continuation of U.S. patent application Ser. No. 13/205,503 filed on Aug. 8, 2011, now U.S. Pat. No. 9,115,900 which issued on Aug. 25, 2015.

U.S. patent application Ser. No. 13/205,503 claims benefit of U.S. Provisional Application Ser. No. 61/371,288 filed on Aug. 6, 2010.

The contents of all related applications listed in this section are incorporated herein by reference.

TECHNICAL FIELD

The present invention relates to systems and methods for generating heat using biomass energy and, more specifically, to systems and methods adapted to transfer heat obtained from solid biofuels to water for domestic use.

BACKGROUND

The term "biomass energy" is used herein to refer to energy obtain from solid biofuels such as wood, sawdust, wood chips, grass cuttings, domestic refused, charcoal, agricultural waste, energy crops, and dried manure. To release biomass energy, solid biofuels are typically burned in a fireplace, stove, or furnace to create heat. Certain solid biofuels, such as wood (e.g., firewood) can be burned directly; other solid biofuels, such as sawdust and wood chips, may be processed into pellets, cubes, pucks, or the like to facilitate burning. The heat generated by burning solid biofuels may be used directly or may be transferred to another medium to facilitate distribution of the heat throughout a dwelling.

In general, the market for biomass reduction systems may be divided into commercial furnaces and residential stoves, fireplaces, and furnaces. The present invention is of particular significance in the context of furnaces designed for use in a residential setting. Commercial furnaces are typically relatively large, and the biofuels used in a commercial furnace typically have a predetermined form factor and composition. For example, commercial furnaces are designed to use densified pellets to facilitate handling of the biofuels and to allow the furnace to be designed for a biofuel having a known energy density. Commercial devices are further typically designed to run continuously and at high utilization or demand and do not operate efficiently at low utilization or demand.

In contrast, in residential or domestic settings, biofuels are commonly burned in a stove or fireplace, and the generated heat is transferred as radiant heat energy to the surrounding environment. Residential stoves and fireplaces are typically relatively inefficient, resulting in incomplete burning of the biofuel and thus the discharge of soot, ash, and gasses through the smokestack or chimney.

Additionally, in North America, biofuels burned in a residential setting most commonly take the form of firewood. Firewood is typically obtained from trees of different species and comes in different shapes, sizes, and moisture content; the form factor and composition of firewood is thus typically not known in advance.

The need exists for biomass reduction furnaces designed for residential settings that do not require biofuels having a known form factor and composition, that transfer heat energy to water for use in domestic purposes (e.g., heating domestic hot water or radiant heating systems), and that result in complete burning of the biofuel.

SUMMARY

The present invention may be embodied as a biofuel heating system for converting biofuel to heat energy to be delivered to a working fluid for transferring heat to a load formed by at least one of a domestic hot water system and a domestic space heating system. The biofuel heating system of the present invention comprises a combustion chamber, a burn-out chamber, a burn-out port, a heat exchange chamber, a heat exchange port, an exhaust port, a heat exchange system, a fan, at least one load sensor, and a controller. The burnout port is arranged to allow fluid to flow out of the combustion chamber and into the burn-out chamber. The heat exchange port is arranged to allow fluid to flow out of the burn-out chamber and into the heat exchange chamber. The exhaust port is arranged to allow fluid to flow out of the heat exchange chamber. The heat exchange system is arranged at least partly within the heat exchange chamber, and the working fluid is circulated between the heat exchange system and the load. The fan is arranged to cause fluid to flow out of the heat exchange chamber through the exhaust port. The at least one load sensor configured to sense a load operating parameter corresponding to a working fluid temperature of the working fluid after the working fluid returns from the load to the heat exchange system. The controller operates the fan based on the load operating parameter such that air flows along a flow path extending through the combustion chamber, through the burn-out port, through the burn-out chamber, through the heat exchange port, through the heat exchange chamber, and out of the exhaust port. The heat exchange system transfers heat energy from air flowing through the heat exchange chamber to the working fluid. The controller operates in a char mode based at least in part on the load operating parameter, where the biofuel remains within the combustion zone during the char mode.

DETAILED DESCRIPTION

Figure 1:
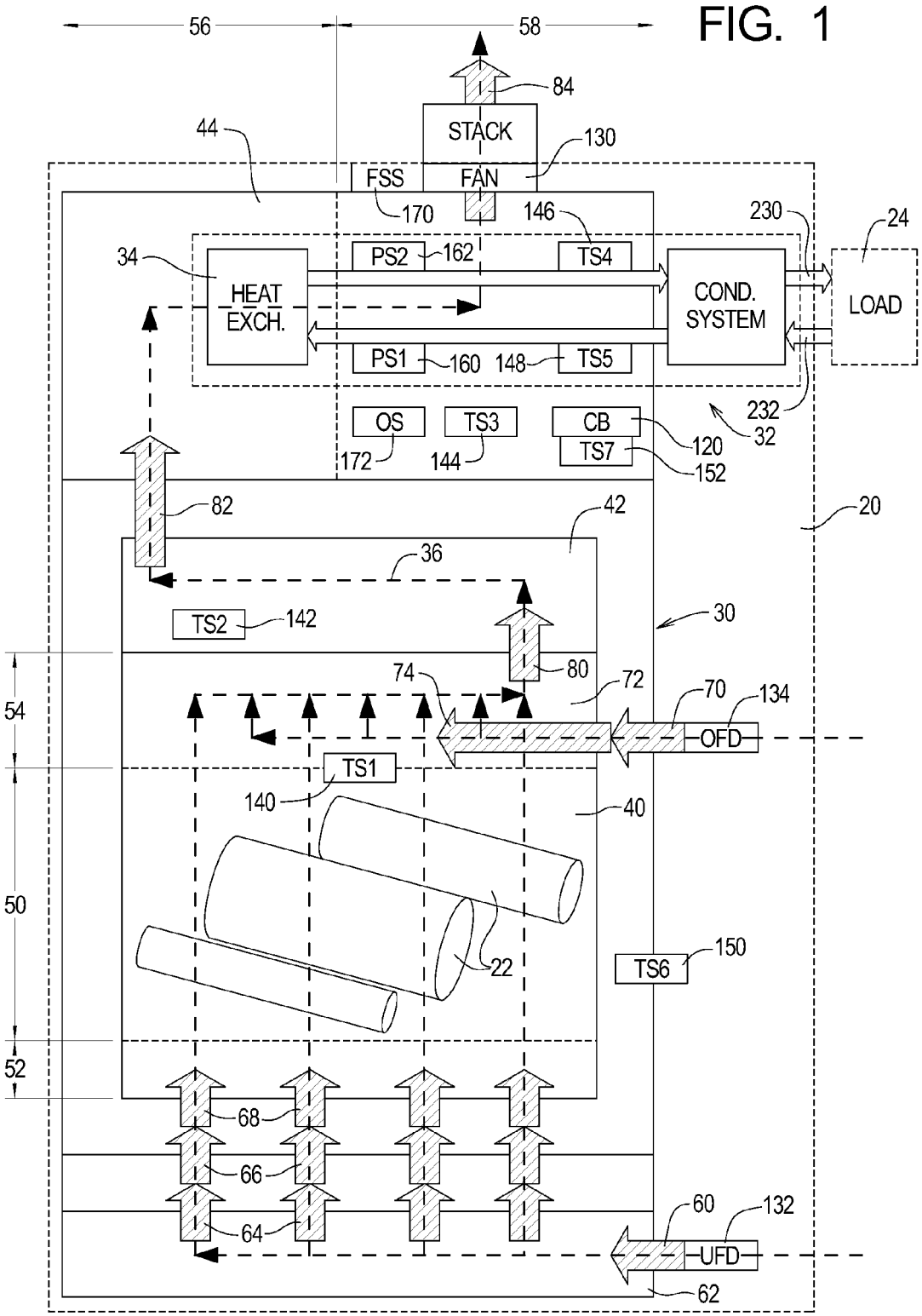
FIG. 1 is a schematic system view a first example biofuel heating system of the present invention.

Depicted in FIGS. 1-6 of the drawing is an example of a biofuel heating system 20 constructed in accordance with, and embodying, the principles of the present invention. The example biofuel heating system 20 is configured to burn biofuel 22 to generate heat energy and transfer this heat energy to a load 24.

The example biofuel 22 is formed by individual pieces of firewood of different sizes, shapes, and composition. Additionally, other forms of biofuels may be used in addition to or instead of firewood. The example biofuel heating system 20 is configured such that the precise size, shape, composition, and moisture content of the example biofuel 22 need not be known in advance.

The load 24 represents a demand for thermal energy and will typically comprise a domestic hot water system and/or a space heating system such as in-floor radiant heating. The precise nature of the load 24 need not be known in advance.

Figure 5:
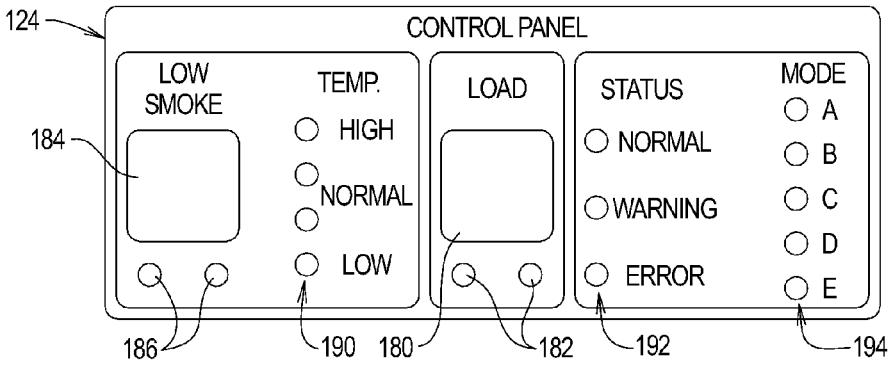
FIG. 5 is a front elevation view of an example control panel forming part of the electrical control system of FIG. 4.
Figure 6:
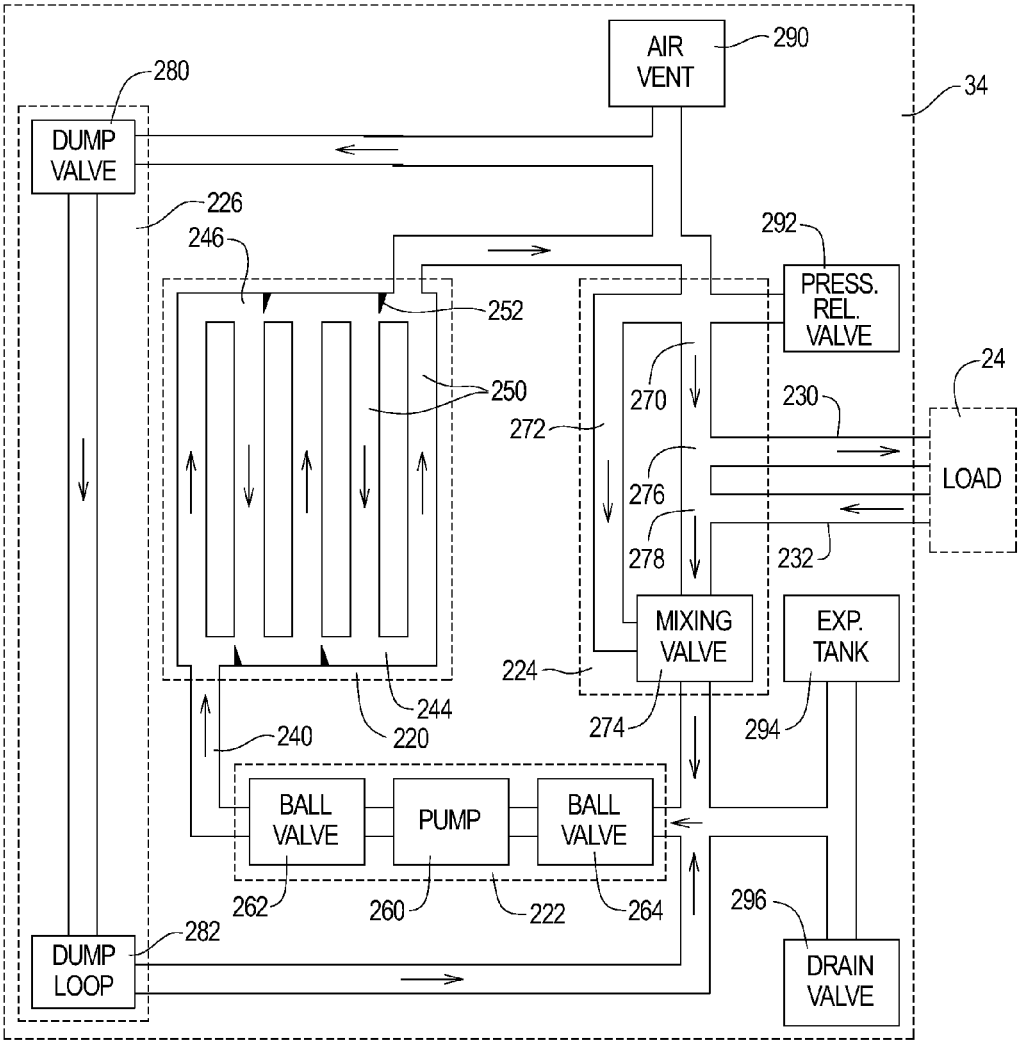
FIG. 6 is a highly schematic representation of the structural and insulation layers that may be used by the example physical structure of FIG. 2.

The example biofuel heating system 20 comprises a furnace assembly 30 (FIGS. 1-3), a control system 32 (FIGS. 1, 4, and 5), and a heat exchange system 34 (FIGS. 1 and 6). The example furnace assembly 30 is a mechanical structure capable of defining a flow path 36 as will be described in further detail below as well as allowing the biofuel 22 to be safely burned and replenished. The example control system 32 controls the burning of the biofuel 22 by controlling the flow of gasses along the flow path 36 based on the operating conditions of the furnace assembly 30 and the heat exchange system 34. The heat exchange system 34 transfers heat conducted by gasses flowing through the furnace assembly 30 to a working fluid, typically a liquid such as water. The working fluid is circulated through the load 24.

At any particular point in time, the temperature of the working fluid reflects the heat energy being generated by the heating system 20 and the demand by the load 24. The demand by the load 24 is, with certain exceptions discussed below, assumed to be outside of the control of the heating system 20. The temperature of the working fluid is thus primarily controlled by continually controlling the heat energy produced by the heating system 20.

To allow the heat energy produced by the heating system 20 to be controlled, a set point temperature (set point) of the working fluid sufficient to satisfy the operating conditions of the load 24 is defined. The set point is typically lower than the boiling point of the working fluid; if water is used as the working fluid, the set point is typically approximately 172° F. but in any event is typically in a first range of 160° F.-180° F. and in any event should be within a second range of 150° F.-200° F. The set point can be increased or decreased based on external environmental conditions such as season, outside temperatures, and the like.

In general, the control system 32 controls the heat energy produced by the heating system 20 by controlling a flow of gasses along the flow path 36. More specifically, the control system 32 alters gas flow along the flow path 36 based on at least one temperature within the furnace assembly and/or the temperature of the working fluid. The control system 32 may further be configured to alter gas flow along the flow path 36 based on at least one pressure associated with the working fluid and an oxygen content of the gasses flowing along the flow path 36.

With the foregoing general understanding of the present invention in mind, the details of the example biogas heating system 20 will now be described in further detail.

The example furnace assembly 30 defines a combustion chamber 40, a burn-out chamber 44, and a heat exchange chamber 46. The combustion chamber 40 defines a combustion zone 50, an under-fire zone 52, and an over-fire zone 54. The under-fire zone 52 is arranged below the combustion zone 50, and the over-fire zone 54 is arranged above the combustion zone 50. The example heat exchange chamber 46 defines a heat exchange zone 56 and an exhaust zone 58.

The example furnace assembly 30 further defines an under-fire inlet 60, an under-fire chamber 62, a plurality of under-fire openings 64, a plurality of under-slots 66, and a plurality of under-fire ports 68. Air may be allowed to flow from the exterior of the heating system 20 into the under-fire zone 52 along an under-fire portion of the flow path 36 extending through the under-fire inlet 60, through the under-fire chamber 62, through the under-fire openings 64, through the under-fire grooves 66, and through the under-fire ports 68.

The example furnace assembly 30 further defines at least one over-fire inlet 70, at least one over-fire chamber 72, and a plurality of over-fire ports 74. Air may also be allowed to flow from the exterior of the heating system 20 into the over-fire zone 54 along an over-fire portion of the flow path 36 extending through the over-fire inlet 70, through the over-fire chamber 72, and through the over-fire ports 74.

The example furnace assembly 30 further defines a burn-out inlet port 80 that allows heated exhaust to flow from the over-fire zone 54 of the combustion chamber 40 into the burn-out chamber 42. At this point, the exhaust contains heated under-fire air and/or over-fire air and other possibly gasses and particulates from combustion process within the combustion chamber 40. The furnace assembly 30 further defines a heat exchange inlet port 82 that allows exhaust to flow from the burn-out chamber 42 to the heat exchange zone 56 of the heat exchange chamber 44. An exhaust port 84 allows exhaust to flow from the exhaust zone 58 of the heat exchange chamber 44 out of the furnace assembly 30.

The example flow path 36 extends along one or both of the under-fire portion and the over-fire portion into the combustion chamber 40, through the burn-out inlet port 80 into the burn-out chamber 42, through the heat exchange port 82 into the heat exchange chamber 44, and out of the heating system 20 through the exhaust port 84.

More specifically, the under-fire ports 68 are arranged such that under-fire air flowing along the under-fire portion of the flow path 36 flows up into a plurality of discrete, spaced locations within the under-fire zone 52 of the combustion chamber 42. After flowing through the under-fire zone 52, the under-fire air continues to flow up through the combustion zone 50 of the combustion chamber 42; under-fire air flowing through the combustion zone 50 flows along the bottoms and around the sides of the biofuel 22 within the combustion zone 50 to encourage complete burning of the biofuel 22. After flowing through the combustion zone 50, the under-fire air separates from the biofuel 22 and continues to flow up along the under-fire portion of the flow path 36 and into the over-fire zone 54. Again, the under-fire air flowing into over-fire zone 54 is not concentrated in any portion of the combustion chamber 42.

Over-fire air flowing along the over-fire portion of the flow path 36 flows into the over-fire zone 54. In particular, the example over-fire ports 74 are arranged such that the over-fire air flows into the over-fire zone 54 from a plurality of discrete, spaced locations on opposite sides of the over-fire zone 54. Additionally, before the over-fire air enters the over-fire inlet(s) 70, the over-fire air flows within a heated air space defined by the furnace assembly 30 such that the over-fire air is pre-heated before entering the over-fire inlet(s) 70.

The under-fire air and over-fire air thus mix within the over-fire zone 54 to encourage continued burning of gasses and particulates rising from the combustion zone 50. However, as will be discussed in further detail below, the heating system 20 may operated in modes in which one or both of the under-fire air and the over-fire air are prevented from flowing along the over-fire and under-fire portions of the flow path 36; in such modes, the mixing of under-fire air and over-fire air will not occur within the over-fire zone 54.

Figure 12:
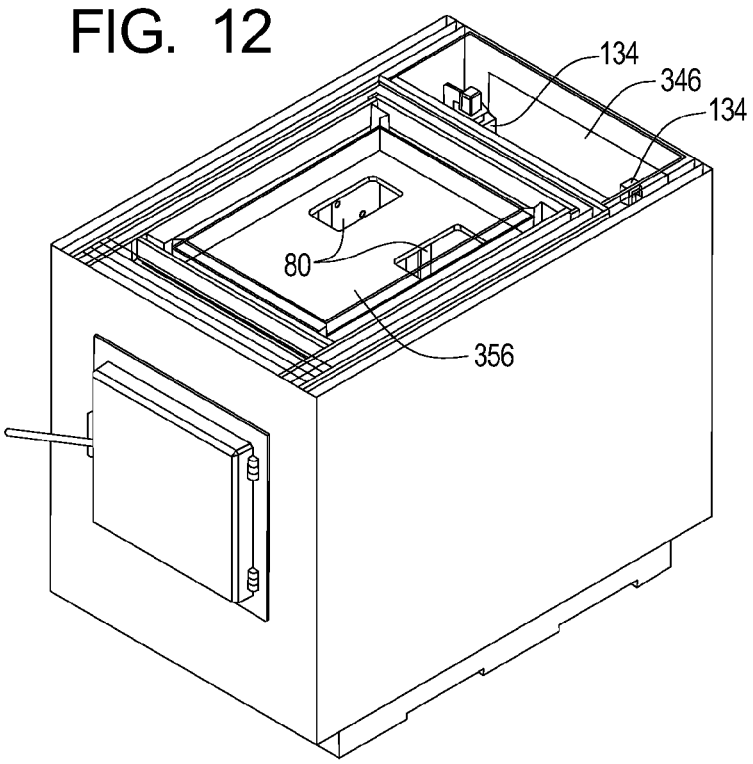
FIG. 12 is an isometric, cross-sectional view depicting a burn-out port in a corbel plate of the first example physical structure of FIG. 2.

After the under-fire air and/or over-fire air flow into the over-fire zone 54, the air and any entrained gasses and particulate material continue along the flow path 36 vertically upward out of a rear portion of the combustion chamber 40 into the burn-out chamber 42 through the burn-out port 80. The example burn-out port 80 is formed by two rectangular openings as perhaps best depicted in FIG. 12 of the drawing. The example flow path 36 then turns such that the flow path extends horizontally from a rear portion to a front portion of the burn-out chamber 42. The example flow path 36 thus follows a serpentine path that allows continued burning of entrained gasses and particulate material within the burn-out chamber 42.

After extending along the burn-out chamber, the example flow path 36 turns and extends vertically upwards again out of the burn-out chamber 42 and into the heat exchange chamber 44 through the heat exchange port 82. As perhaps best shown in FIG. 13 of the drawing, the heat exchange port 82 is an elongate rectangular opening. At this point, practically all of the gasses and particulate matter entrained within the air flowing along the flow path 36 have been completely burned and converted to heat energy. The air flowing along the flow path 36 through the heat exchange port 82 carries a large amount of heat energy but contains negligible gasses and particulates.

After passing through the heat exchange port 82, the example flow path 36 turns and extends horizontally again from a front portion (i.e., the heat exchange zone 56) of the heat exchange chamber 44 to a rear portion (i.e., the exhaust zone 58) of the heat exchange chamber 44. A significant portion of the heat energy carried by the air flowing through the heat exchange zone 56 is transferred to a working fluid within the heat transfer system 34 as will be described in further detail below. The air flowing along the flow path 36 into the exhaust zone 58 is significantly cooler and contains negligible gasses and particulates.

The parameters of the example heating system 20 are predetermined to maintain a temperature of the air within the exhaust zone within pre-determined parameters to avoid condensation. Avoiding condensation slightly reduces the efficiency of the heating system but avoids the production of condensate, which is slightly acidic and would require the use of corrosion resistant materials and a condensate drainage system.

Figure 2:
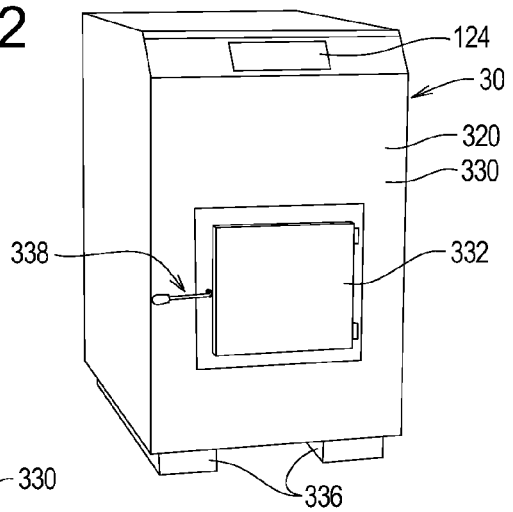
FIG. 2 is a perspective view of a first example physical structure that may be used by the first example biofuel heating system of FIG. 1.
Figure 4:
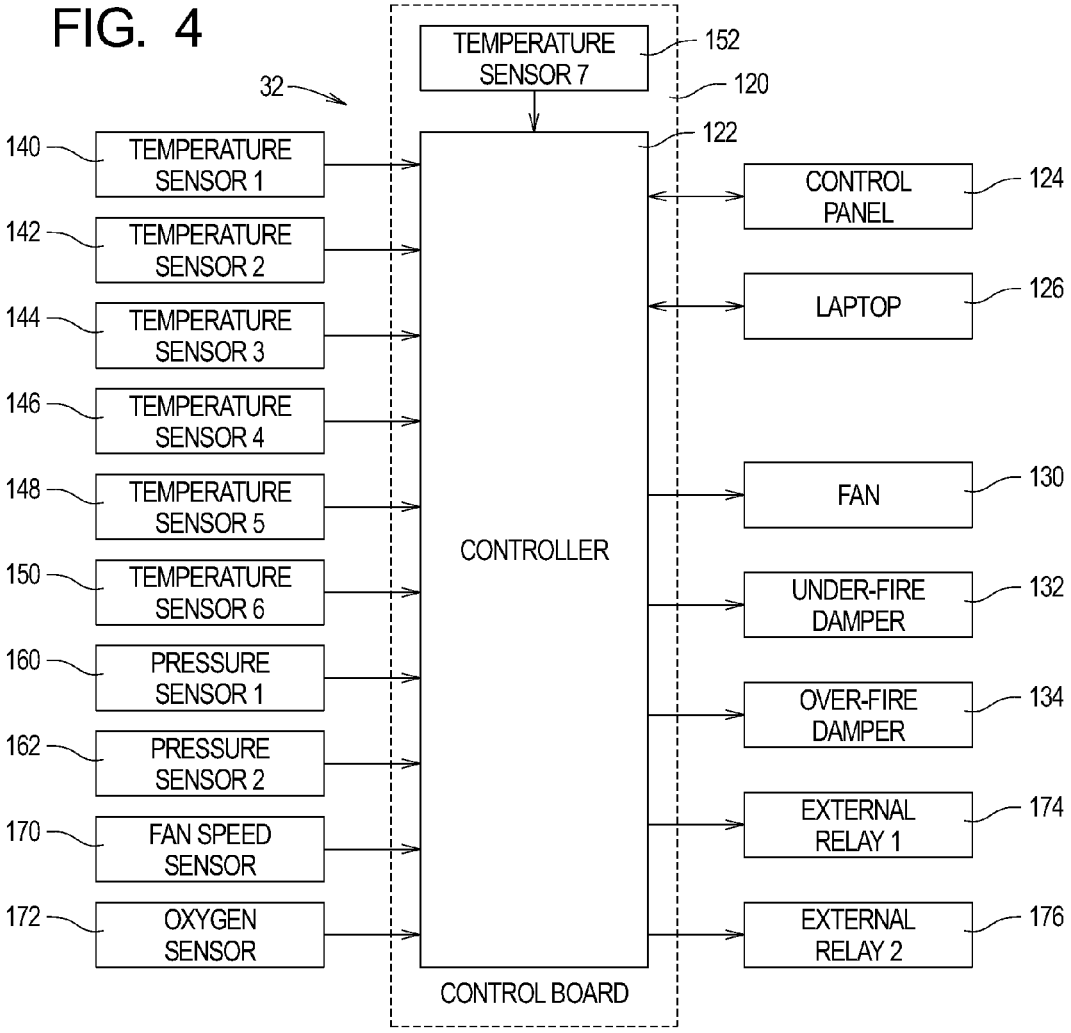
FIG. 4 is a schematic block diagram illustrating an electrical control system that may be used by the first example biofuel heating system of FIG. 1.

Referring now to FIGS. 1 and 4, the example control system 32 will be described in further detail. FIG. 4 illustrates that the control system 32 comprises a control board 120 on which is mounted a controller 122. A control panel 124 is operatively connected to the example controller 122; the example control panel 124 is mounted on an external surface of the furnace assembly 30 accessible to the user as shown in FIG. 2. Further, FIG. 4 shows that the control board 120 may be provided with a communications port for allowing an external computer 126 to be connected to the controller 122.

FIGS. 1 and 4 illustrate that the example control system 32 further comprises a fan 130, an under-fire damper 132, and an over-fire damper 134. As best shown in FIG. 1, the fan 130 is arranged adjacent to the exhaust port such that the controller 122 is capable of operating the fan to cause air and other gasses to flow along the flow path 36 and out of the exhaust port 84. FIG. 1 further shows that the under-fire damper 132 and the over-fire damper 134 are associated with the under-fire inlet 60 and the over-fire inlet 70, respectively. The controller 122 is capable of independently placing the dampers 132 and 134 in either open or closed configurations to prevent or allow air to flow along the under-fire portion of the flow path 36 and over-fire portion of the flow path 36, respectively. In another form of the invention, one or both of the dampers 132 and 134 may be operated in any one of a continuation of partially open configurations to provide finer control of the flow of fluid through the under-fire inlet 60 and the over-fire inlet 70, respectively.

The controller 122 may thus control volume of flow along the flow path 36 by controlling a speed of the fan 130. The controller 122 may also allow air to flow into the under-fire zone 52 along the under-fire portion of the flow path 36 and/or into the over-fire zone 54 along the over-fire portion of the flow path 36. By closing one or both of the dampers 132 and 134, the controller 122 may prevent air from flowing into the under-fire zone 52 along the under-fire portion of the flow path 36 and/or into the over-fire zone 54 along the over-fire portion of the flow path 36.

The example controller 122 is further operatively connected to first and second temperature sensors 140 and 142. The first temperature sensor 140 is arranged to measure a temperature of air and other gasses within the combustion chamber 40. The example first temperature sensor 140 is arranged at a juncture between the combustion zone 50 and the over-fire zone 54 of the combustion chamber 40. The second temperature sensor 142 is arranged to measure a temperature of the exhaust within the burn-out chamber 42. The example second temperature sensor 142 is arranged at adjacent to heat exchange port 82 and is spaced from the burn-out port 80.

In one configuration, the example controller 122 may be configured to control generation of heat by the heating system 20 by controlling the fan 130 and the dampers 132 and 134 based on a relationship between the temperatures sensed by the first and second temperature sensors 140 and 142.

The example controller 122 is further operatively connected to a third temperature sensor 144. The third temperature sensor 144 is arranged to measure a temperature of the exhaust within the exhaust zone of the heat exchange chamber 44. At this point, much of the heat energy is removed from the exhaust. The example first temperature sensor 140 is arranged adjacent to the exhaust port 84.

In another configuration, the example controller 122 may be configured to control generation of heat by the heating system 20 by controlling the fan 130 and the dampers 132 and 134 based on relationships among the temperatures sensed by the first, second, and third temperature sensors 140, 142, and 144.

The example controller 122 is further operatively connected to fourth and fifth temperature sensors 146 and 148. The fourth temperature sensor 146 is arranged to measure a temperature of the working fluid flowing to the load 24. The fifth temperature sensor 148 is arranged to measure a temperature of the working fluid flowing back from the load 24.

In another configuration, the example controller 122 may be configured to control generation of heat by the heating system 20 by controlling the fan 130 and the dampers 132 and 134 based on relationships among the temperatures sensed by the first, second, fourth, and fifth temperature sensors 140, 142, 146, and 148. In yet another configuration, the example controller 122 may be configured to control generation of heat by the heating system 20 by controlling the fan 130 and the dampers 132 and 134 based on relationships among the temperatures sensed by the first, second, third, fourth, and fifth temperature sensors 140-148.

The example controller 122 is further operatively connected to sixth and seventh temperature sensors 150 and 152. The sixth temperature sensor 150 is arranged to measure a temperature of a refractory wall portion of the furnace assembly 130. The seventh temperature sensor 152 is arranged to measure a temperature of the control board 120. In any of the configurations described herein, the example controller 122 may further be configured to control generation of heat by the heating system 20 based on the temperature sensed by either or both of the sixth and seventh temperature sensors 150 and 152.

The example controller 122 is further operatively connected to first and second temperature sensors 160 and 162. The first pressure sensor 160 is arranged to measure a pressure of the working fluid flowing to the load 24. The second pressure sensor 162 is arranged to measure a pressure of the working fluid flowing back from the load 24. In any of the configurations described above, the example controller 122 may further be configured to control generation of heat by the heating system 20 based on the pressure sensed by either or both of the first and second pressure sensors 160 and 162.

The example controller 122 is further operatively connected to a fan speed sensor 170. The fan speed sensor 170 is arranged to measure a rotational speed of the fan 130. In any of the configurations described above, the example controller 122 may further be configured to control generation of heat by the heating system 20 based on the fan speed sensed by fan speed sensor 170.

The example controller 122 is further operatively connected to an oxygen sensor 172. The oxygen sensor 172 is arranged to measure the oxygen content of the exhaust within the exhaust zone 58 of the heat exchange chamber 44. In any of the configurations described above, the example controller 122 may further be configured to control generation of heat by the heating system 20 based on the oxygen content sensed by oxygen sensor 170.

FIG. 4 further illustrates that the example control system 30 comprises first and second external relays 174 and 176. One or both of the external relays 174 and 176 may be connected to components within the load 24 to adjust a state of the load 24 to facilitate control of the heating system 20. For example, in certain situations, the heat energy produced by the heating system 20 may exceed the demand by the load 24 operating in a normal mode. To maintain proper operation of the heating system 20, the controller 122 may operate one or both of the external relays 174 and 176 to place the load in a warm mode in which the demand by the load 24 is increased to remove excess heat from the heating system 20. The use of two external relays 174 and 176 allows the establishment of as many as three warm modes that may be used to increase demand by the load 24.

FIG. 5 illustrates the example control panel 124 that may form part of the example control system 32. The example control panel 124 comprises a load button 180, one or more load status lights 182, a door open button 184, one or more door open status lights 186, a set of temperature indicator lights 190, a set of system status lights 192, and a set of error status lights 194. The controller 122 is connected to the control panel 124 such that the control program running on the controller 122 receives an input when the load and door open buttons 180 and/or 184 are depressed and is capable of energizing or de-energizing any of the lights 182, 186, 190, 192, and/or 194 as determined by the logic implemented by the control program. The control 124 may take other forms such as a LED display presenting a user interface capable of indicating status using words, numbers, symbols, and/or sounds.

The computer 124 depicted in FIG. 4 runs a host program that interfaces with the control program running on the controller 122. The host program may be used to run more complex diagnostics and the record and display data stored by the controller 122. The host program running on the computer 124 may in turn be connected to a remote computer running a remote program capable of running additional diagnostics and also of uploading updated control programs to the controller 122.

Figure 3:
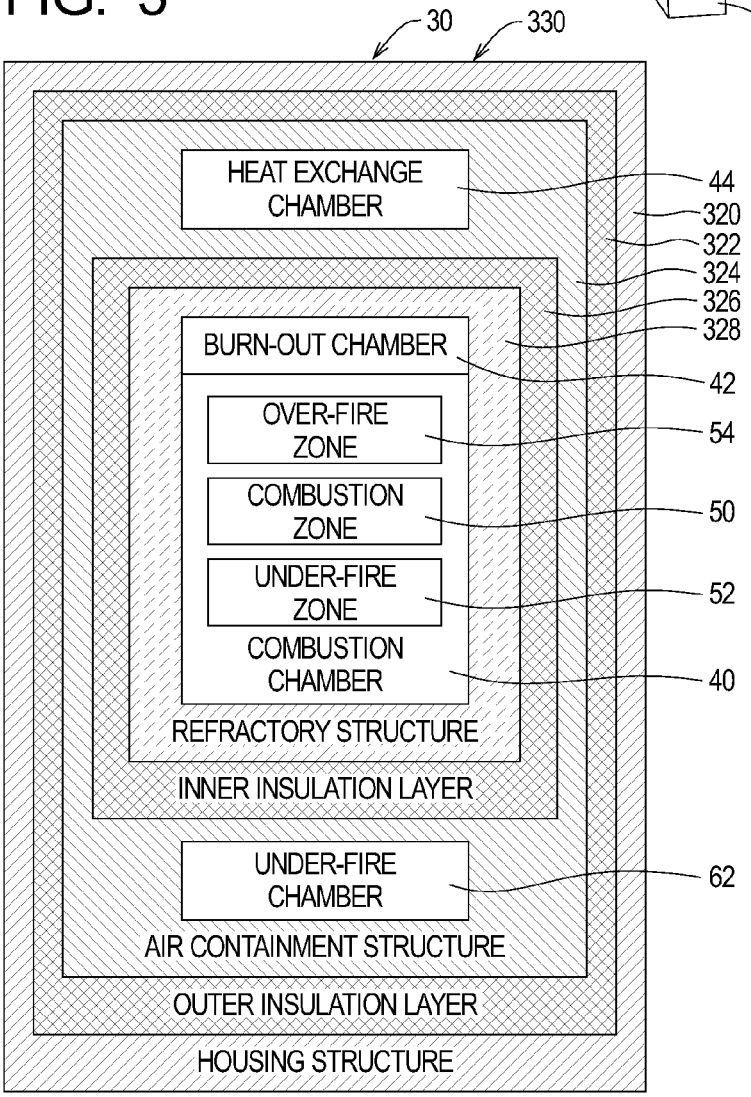
FIG. 3 is a schematic view of a heat transfer system that may be used by the first example biofuel heating system of FIG. 1.

Referring now to FIGS. 1 and 3, the heat transfer system 34 will now be described in further detail. As perhaps best shown in FIG. 3, the example heat transfer system 34 comprises a heat exchanger 220, a circulation system 222, a conditioning system 224, and a heat dump system 226. FIGS. 1 and 3 both illustrate a supply conduit 230 and a return conduit 232 that are operatively connected between the heat transfer system 34 and the load 24.

The heat exchanger 220 defines a heat exchanger input 240 and a heat exchanger output 242. The heat exchanger input 240 is connected to an input manifold 244, while the heat exchanger output 242 is connected to an output manifold. A plurality of heat transfer pipes 250 are connected between the input manifold 244 and the output manifold 246. Baffles 252 are arranged within the manifolds 244 and 246 to encourage flow of fluid within the heat exchanger 220 that optimizes transfer of heat from air and gasses flowing around the heat exchanger 220 to working fluid flowing through the heat transfer pipes 250.

The circulation system 222 comprises a pump 260 and first and second ball valves 262 and 264. The ball valves 262 and 264 are normally open such that operation of the pump 260 causes working fluid to flow in a loop through the conditioning system 224 and the heat exchanger 220. The ball valves 262 and 264 may be closed to facilitate removal and replacement of components of the heat transfer system 26.

The conditioning system 224 comprises a load conduit 270, a bypass conduit 272, a mixing valve 274, a supply tee 276, and a return tee 278. The supply tee 276 and return tee 278 are connected in series along the load conduit 270, and the bypass conduit 272 is connected in parallel with the supply tee 276 and a return tee 278. The mixing valve 274 is connected to a downstream junction between the load conduit 270 and bypass conduit 272. The supply tee 276 is connected to the supply conduit 230, and the return tee 278 is connected to the return conduit 232.

During normal operation of the heat transfer system 34, operation of the pump causes working fluid to flow through the heat exchanger input 240, into the input manifold 244, through the heat transfer pipes 250, into the output manifold 246, out of the heat exchanger output 242, through the load and bypass conduits 270 and 272, through the mixing valve 274, and back to the pump 260. The heat transfer system 34 thus defines a heat transfer loop that flows through the heat exchanger 220, the conditioning system 224, and the circulation system 222.

The load 24 contains a load circulation pump (not shown) that causes the working fluid to flow in a load loop from the load conduit 270, through the supply conduit 230, through the load 24, and back through the return conduit 232 into the load conduit 270.

When the heat transfer system 34 is connected to the load 24, the working fluid thus flows through two loops that are connected within the load conduit 270 between the supply tee 276 and the return tee 274. The working fluid in the heat transfer loop thus mixes with the working fluid in the load loop between the supply and return tees 276 and 278 to transfer heat from the heat transfer loop to the load loop.

As mentioned above, the construction and operation of the load 24 are unknown. The conditioning system 224 is configured to allow the heat transfer system 34 substantially to isolate the flow of fluid within the heat exchanger 220 and the circulation system 222 of the heat transfer system 34 from fluctuations in heat and pressure in the working fluid flowing through the load loop.

Referring for a moment back to the heat dump system 226 as depicted in FIG. 3, the heat dump system 226 is an optional system that can be used to reduce the heat flowing through the heat transfer loop defined by the heat transfer system 34. In particular, the heat dump system 226 comprises a dump valve 280 and a dump loop 282. Should the temperature of the working fluid flowing through the heat transfer loop exceed certain predetermined parameters, the dump valve is opened to allow at least a portion of the fluid out of the heat exchanger 229 to flow through the dump loop 282 rather than through the conditioning system 224 and back into the heat exchanger 220. The working fluid flowing through the heat transfer loop thus bypasses the heat exchanger 220, instead flowing through the dump loop 282 where at least a portion of the heat energy within the working fluid is transferred out of the heat exchange system 34.

FIG. 3 further illustrates that the example heat transfer system 34 comprises an air vent 290 for allowing air to be removed from the working fluid within the heat transfer loop. A pressure relief valve 292 is configured to release the working fluid from the heat transfer loop should the pressure of the working fluid within the heat transfer system 34 exceed certain predetermined parameters. An expansion tank 294 is arranged to accommodate expansion and contraction of the working fluid as the temperature of the working fluid fluctuates. A drain valve 296 allows working fluid to be removed from the heat transfer system 34.

Referring now for a moment to FIG. 3 of the drawing, it can be seen that the example furnace assembly 30 of the heating system 20 comprises a housing structure 320, an outer insulation layer 322, an air containment structure 324, an inner insulation layer 326, and a refractory structure 328. FIG. 3 is intended to schematically represent the functional relationships among the various components of the furnace assembly 30 but does not necessarily represent the precise spatial relationships among these components.

Figure 15:
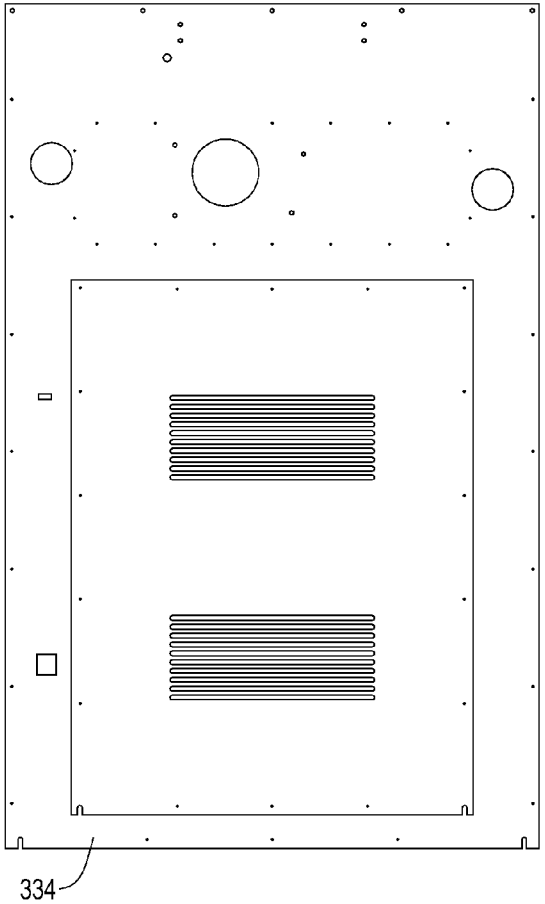
FIG. 15 is a rear elevation, view of the back panel of the first example physical structure of FIG. 2.
Figure 14:
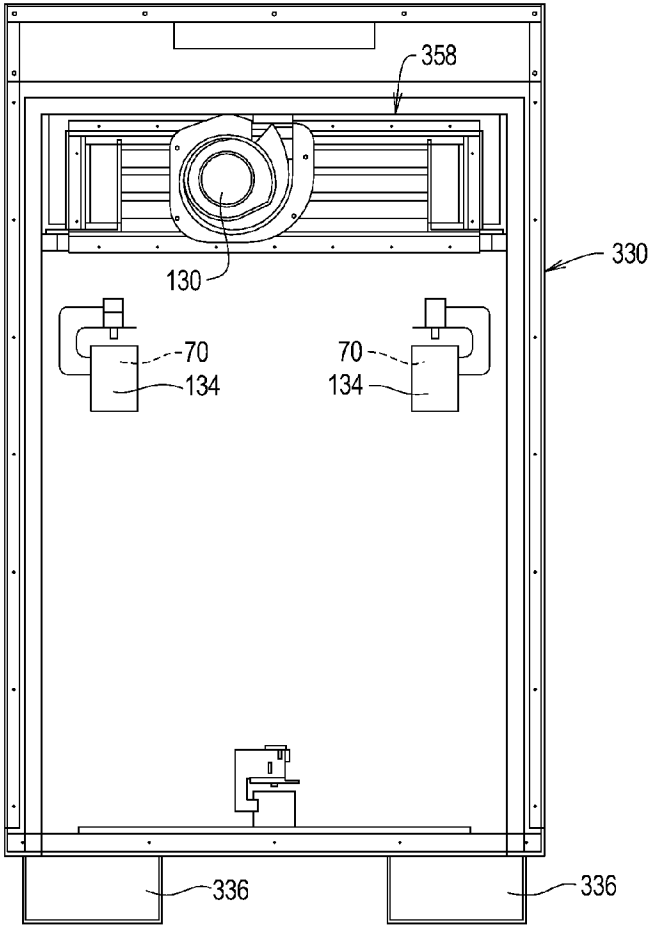
FIG. 14 is a rear elevation, view of the first example physical structure of FIG. 2 with a back panel removed.

Referring to FIGS. 2, 14, and 15 of the drawing, it can be seen that the housing structure 320 of the example furnace assembly 30 comprises a housing assembly 330, a door assembly 332, a rear panel 334, stand members 336, and a latch assembly 338.

Figure 11:
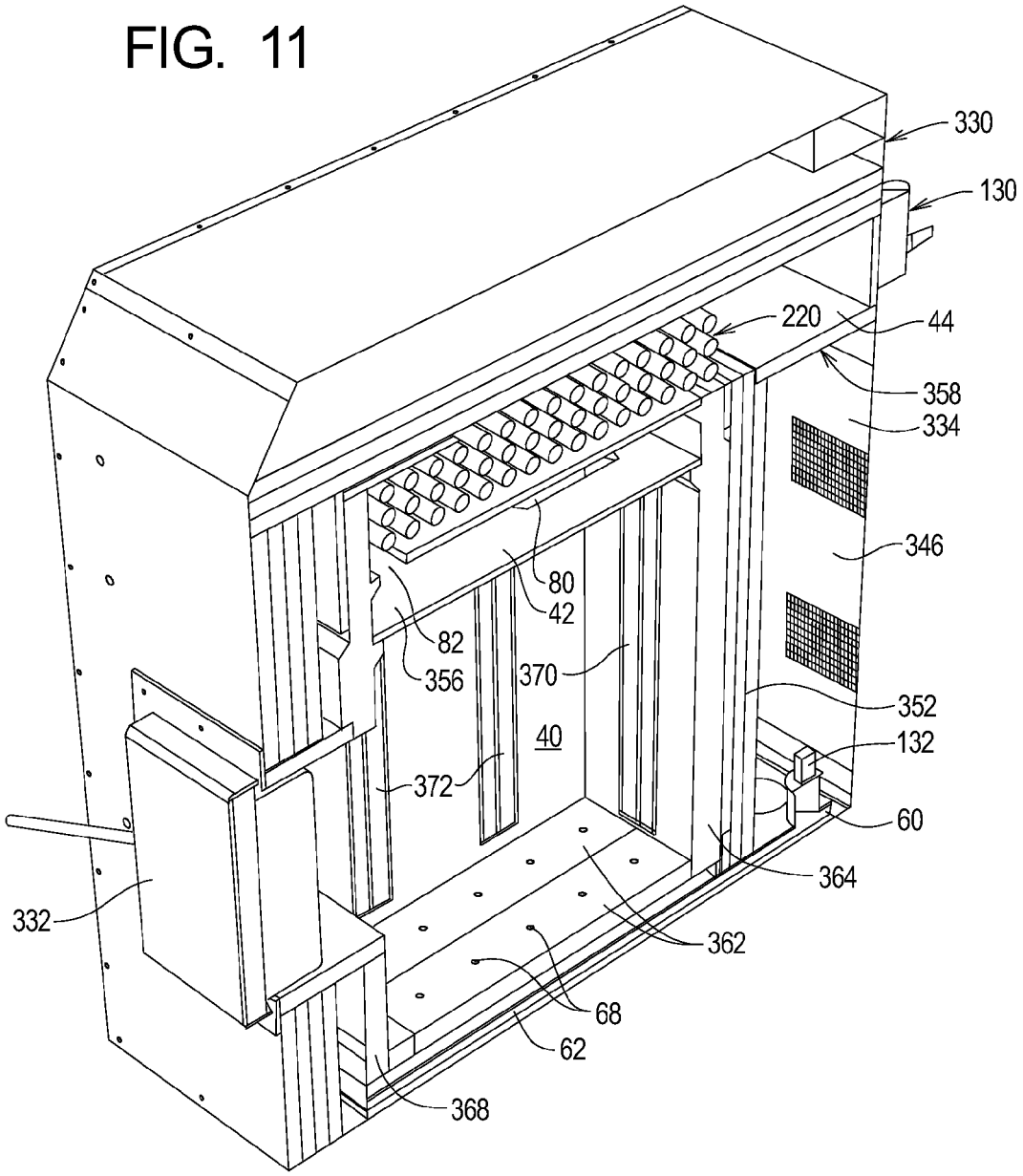
FIG. 11 is a perspective, section view depicting the first example physical structure of FIG. 2.

FIGS. 2 and 11 perhaps illustrate that the outer insulation layer 322 is formed by a plurality of outer insulating sheets 340, while the inner insulation layer 324 is formed by a plurality of inner insulating sheets 342. Side air gaps 344 and a rear air gap 346 provide additional thermal insulation as will be described in further detail below.

In addition, the over-fire air first flows along the rear air gap 346 before entering the over-fire inlet(s) 70. Because the rear air gap 346 and over-fire channel(s) are adjacent to the refractory structure 328, radiant heat from the refractory structure 328 warms air within the rear air gap 346 and the over-fire channel(s) 72, thus preheating the over-fire air before the over-fire air enters the over-fire zone 54 of the combustion chamber 40.

Figure 13:
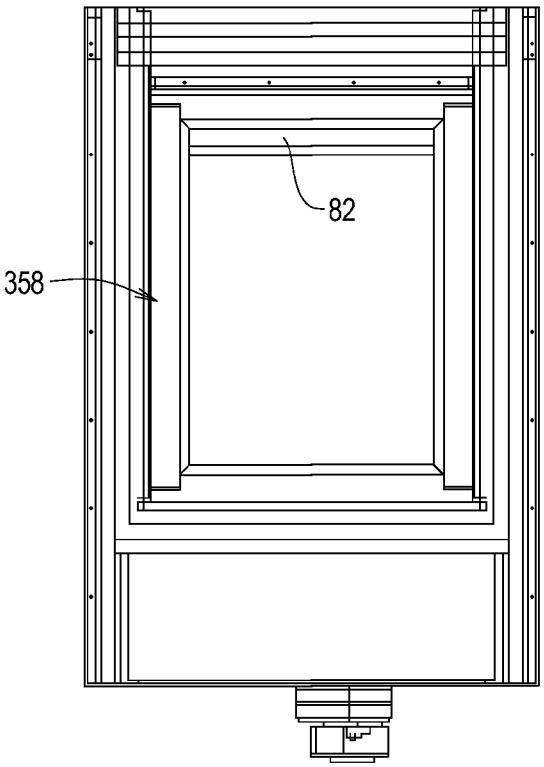
FIG. 13 is bottom plan, cross-sectional view depicting a heat exchange port in a heat exchange box of the first example physical structure of FIG. 2.

The air containment structure 324 comprises a grate box 350 (FIG. 8), a rear wall 352 (FIG. 11), side walls 354 (FIG. 14), a corbel plate 356 (FIGS. 11 and 12), and a heat exchange box 358 (FIGS. 11 and 13). The grate box 350 defines the under-fire inlet 60, the under-fire chamber 62, and the under-fire openings 64. The rear wall 352 defines the over-fire inlets 70. The corbel plate 356 defines the burn-out port 80, and the heat exchange box 358 defines the heat exchange chamber 44, the heat exchange port 82, and the exhaust port 84. The burn-out chamber 42 is defined between the corbel plate 356 and the heat exchange box 358.

Figure 7:
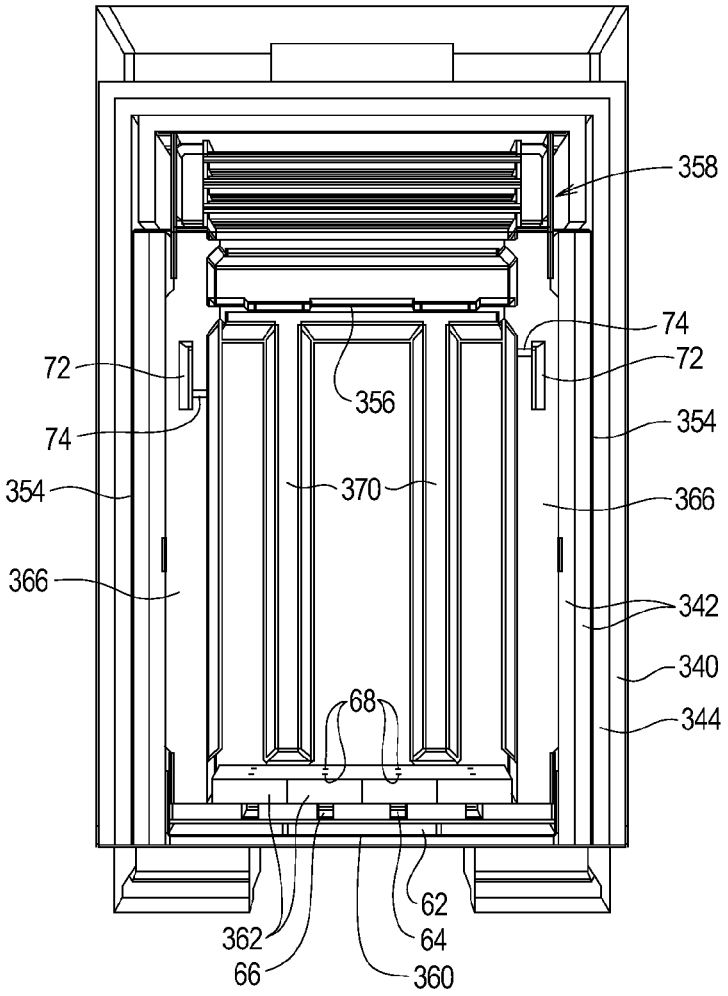
FIG. 7 is a front elevation, section, perspective view depicting the interior of the first example physical structure of FIG. 2.
Figure 16:
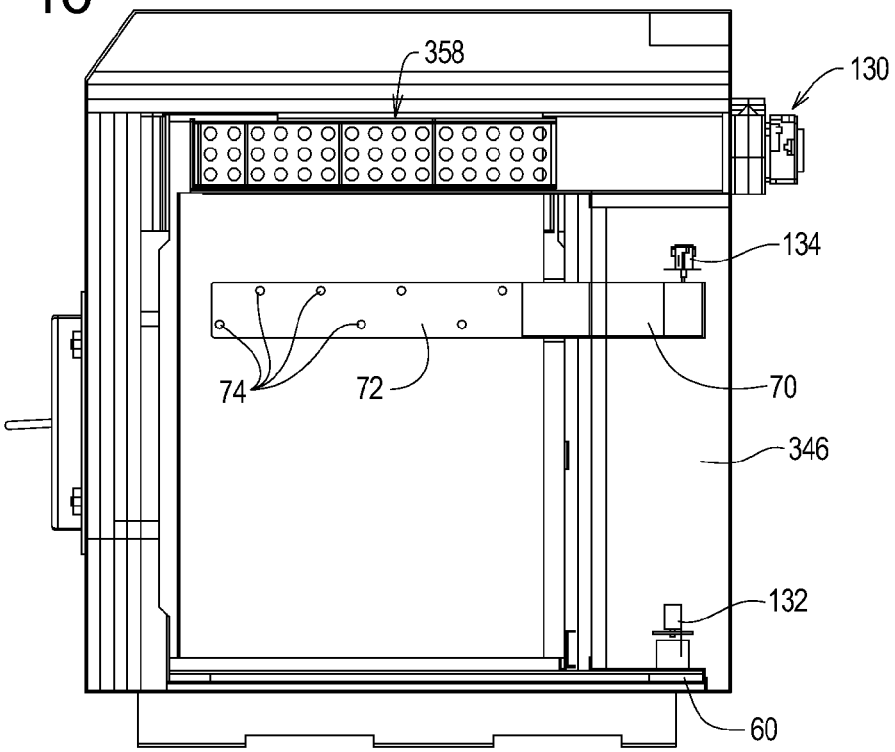
FIG. 16 is a perspective, section view depicting the over-fire and under-fire channels defined by the first example physical structure of FIG. 2.
Figure 17:
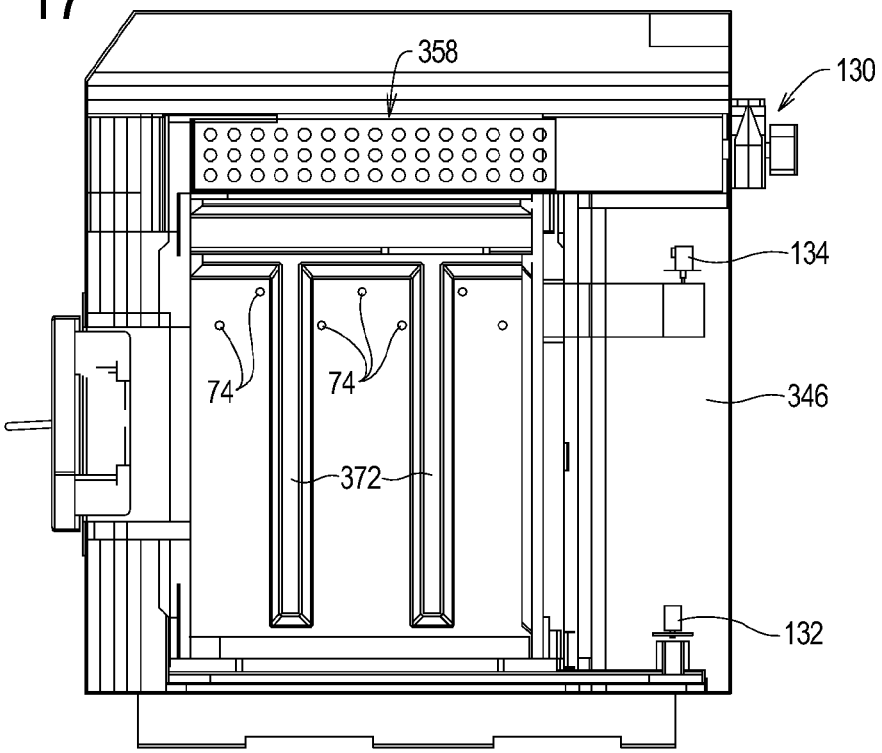
FIG. 17 is a perspective, section view depicting the side walls of a fire box defined by the first example physical structure of FIG. 2.

The refractory structure 328 is formed by a support plate 360 (FIGS. 7 and 8), a plurality of support blocks 362 (FIGS. 6 and 10), a refractory rear wall 364 (FIGS. 7 and 11), refractory side walls 366 (FIGS. 7, 11, and 17), and a refractory front wall 368 (FIGS. 11 and 17). The refractory rear wall 364 defines a pair of rear wall buttresses 370, while the refractory side walls 366 each define a pair of side wall buttresses 372. The refractory structure 328 defines the combustion chamber 40, while the refractory side walls 366 define the over-fire channels 72 (FIGS. 7 and 16) and the over-fire ports (FIGS. 16 and 17). The support plate 360 defines the under-fire grooves 66, and the support blocks 362 define the under-fire ports 68. The rear and side wall buttresses 370 and 372 prevent the biofuel 22 from coming into contact with the refractory rear and side walls 364 and 366, respectively, such that under-fire air is prevented from flowing around all sides of the biofuel 22.

Figure 18:
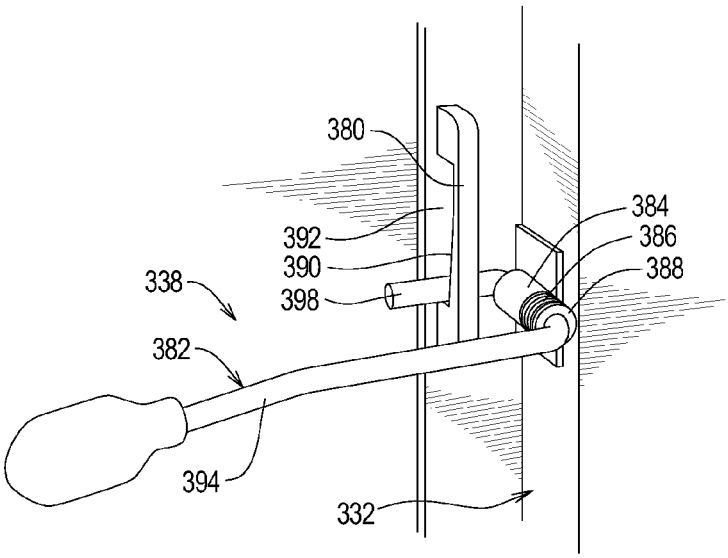
FIG. 18 is a perspective view of an example latch system that may be used by the first example physical structure of FIG. 2.
Figure 19A:
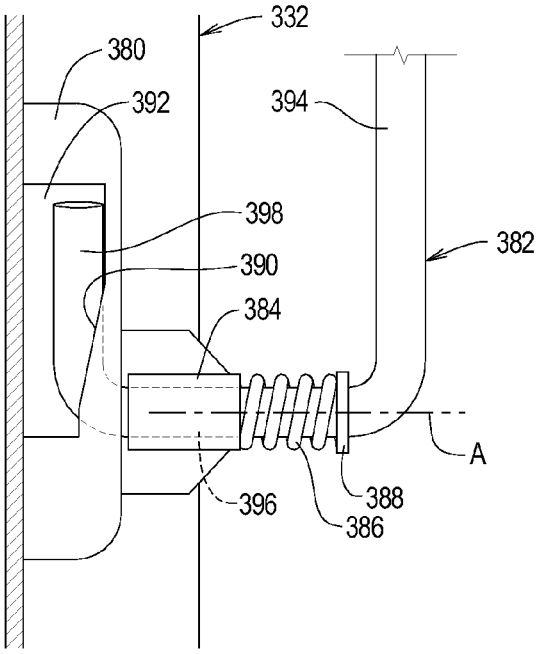
FIGS. 19A and 19B are side elevation view of the example latch system of FIG. 18 in open and closed configurations, respectively.
Figure 19B:
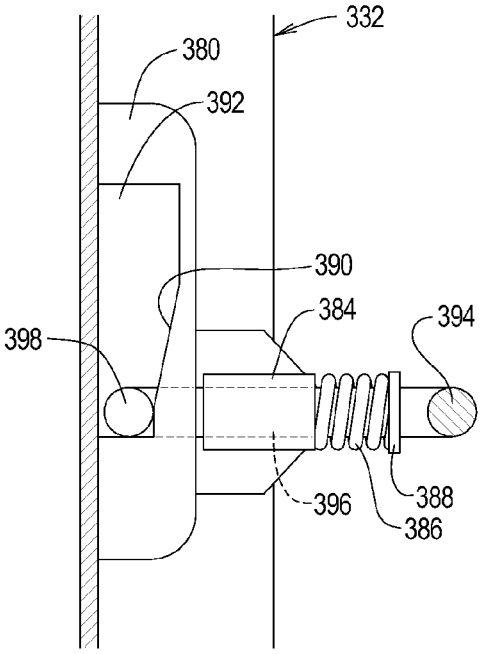

As best shown in FIGS. 18, 19A, and 19B, the example latch assembly 338 comprises a latch plate 380, a latch member 382, a latch collar 384, a latch spring 386, and a latch washer 388. The latch plate 380 is rigidly connected to the housing structure 320 to define a latch edge 390 and a latch opening 392. The latch member 384 defines a handle portion 394, a pivot portion 396, and a lock portion 398. The latch washer 388 is rigidly connected to the latch member 382 at a juncture between the handle portion 394 and the pivot portion 396. The latch spring 386 is arranged over the pivot portion 396 adjacent to the latch washer 388. The latch collar 384 is rigidly connected to the door assembly 332 such that the latch spring 386 is arranged between the latch collar 384 and the latch washer 388 and the pivot portion 396 of the latch member 382 is rotates relative to the door assembly 332 about a pivot axis A. The latch edge 390 is angled with respect to pivot axis A. In use, the handle portion 394 is rotated down such that the lock portion 398 enters the latch opening 392 (FIG. 19A). Continued rotation of the handle portion 394 causes the lock portion 398 to engage the latch edge 390 such that pivot portion 396 is displaced along the pivot axis A towards the housing structure 320, thereby compressing the latch spring 386. The latch assembly 338 is depicted in an open configuration in FIG. 19A and in a closed configuration in FIGS. 18 and 19B. The design of the example latch assembly 338 forms a uniform air seal around the door assembly 332 and yields increased operating life of both the components of the latch assembly 338 and the hardware used by the door assembly 332.

Figure 8:
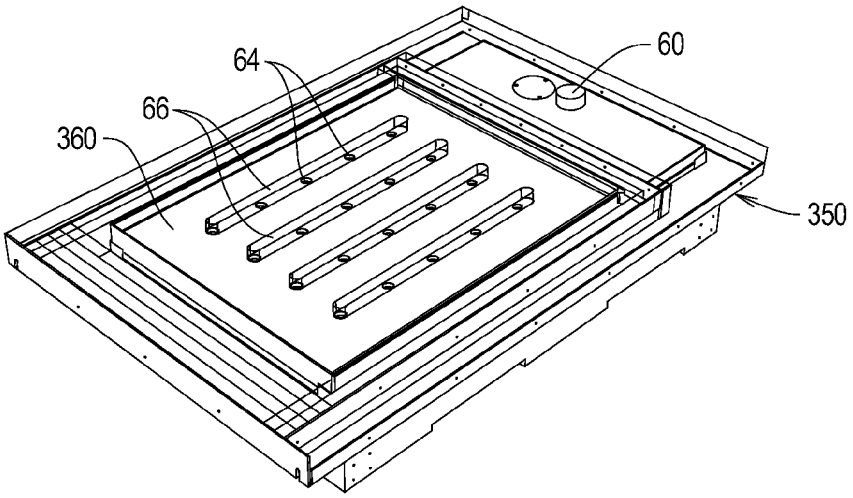
FIG. 8 is a perspective, section view depicting the grate assembly of the first example physical structure of FIG. 2.
Figure 9:
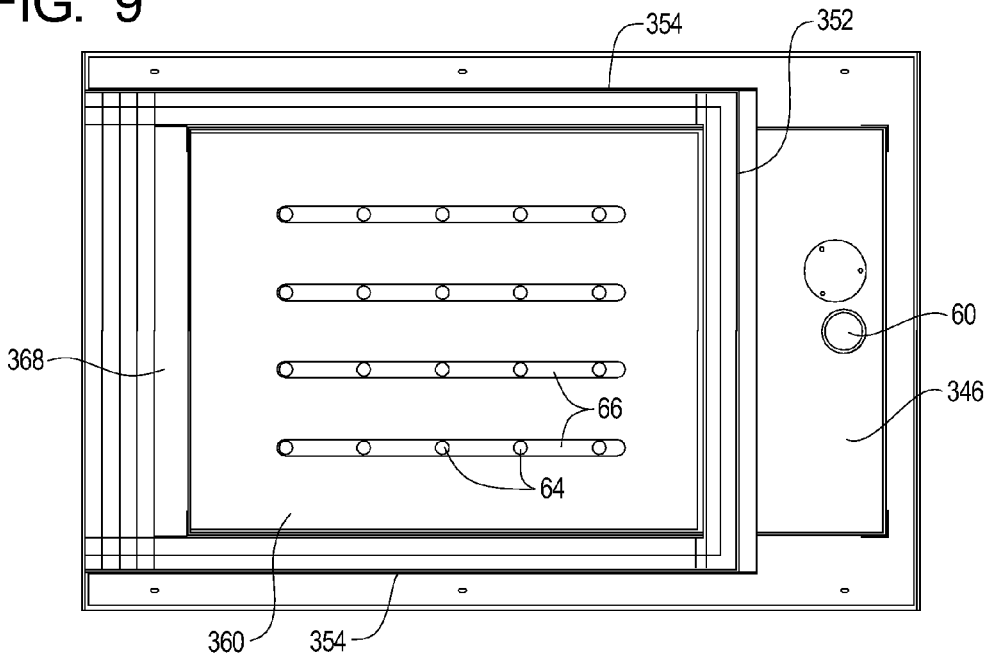
FIG. 9 is a top plan, section view depicting a portion of the grate assembly of the first example physical structure of FIG. 2.
Figure 10:
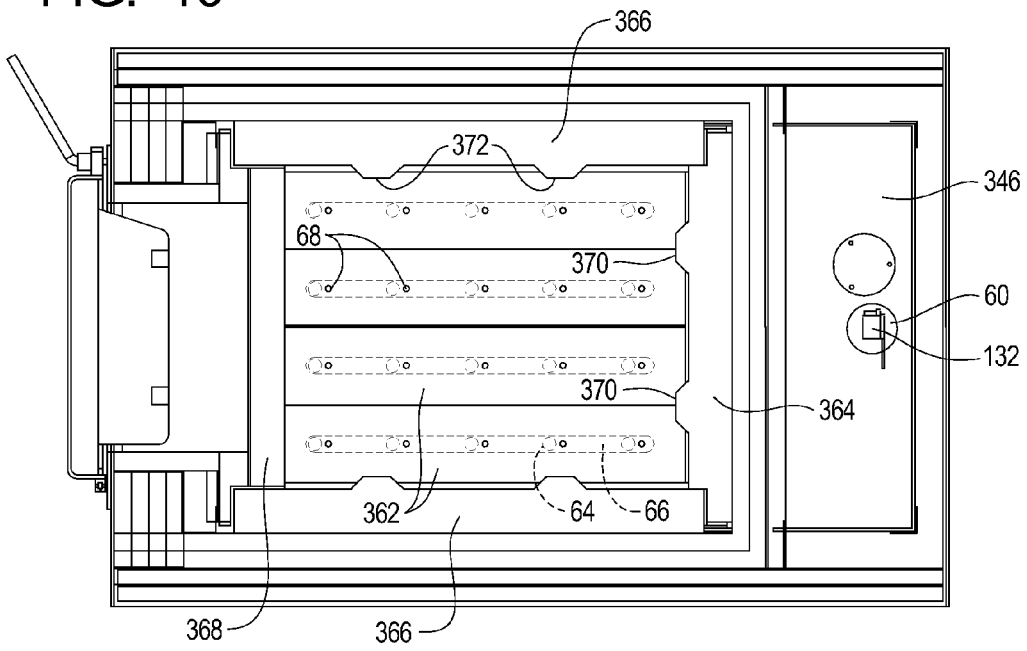
FIG. 10 is a top plan, section view depicting a portion of the grate assembly of the first example physical structure of FIG. 2.

As best shown in FIGS. 8 and 9, the support plate 360 is placed on top of the grate box 350 such that the under-fire openings 364 are aligned with the under-fire grooves 66 to allow fluid communication from the under-fire chamber 62 into the under-fire grooves 66. FIG. 10 illustrates that the support blocks 362 are arranged on the support plate 360 such that the under-fire ports 68 are aligned with the under-fire grooves 66. However, the under-fire ports 68 are misaligned with the under-fire openings 364 to inhibit movement of contaminates from the combustion chamber into the under-fire chamber 62.

The refractory side walls 366 are supported such that the over-fire channels 72 formed therein are substantially aligned with the over-fire inlets 70 formed in the rear wall 352 of the air containment structure 324.

The example air containment structure 324 is assembled such that, during normal operation of the heating system 20 (with the door assembly 332 closed as shown in FIG. 1), air enters the combustion chamber 40 either through the under-fire ports 68 or through the over-fire ports 74. Operation of the under-fire and over-fire dampers 132 and 134 as generally described above thus effectively control the flow of air into the combustion chamber 40.

The components of the example refractory structure 328 are made of refractory materials such as ceramics and/or vermiculite capable of maintaining the shapes of these components under the range of temperatures expected during normal operation of the heating system 20.

The insulation layers 322 and 326 are configured to inhibit the transfer of heat from the combustion chamber 40 to the exposed surfaces of the housing structure 320 such that these exposed surfaces do not present a burn or fire hazard during normal operation of the heating system 20.

The housing structure 320 is made of rigid materials assembled to support the weight of the biofuel 22, the air containment structure 324, the refractory structure 326, the heat transfer system 34, and any working fluid within the heat transfer system 34.

With the foregoing understanding of the furnace assembly 30 and heat transfer system 34, the following Table A describes in further detail the various sensors that may be used by the example control system 32.

TABLE A

| Sensors | | | |
|---|---|---|---|
| Sensor Name | Sensor Location | Sensor Signal | Sensor Description |
| first temperature sensor 140 | combustion chamber 40 just above Combustion zone 50 | TS1 | temperature within combustion chamber |
| second temperature sensor 142 | burn-out chamber 42 adjacent to heat exchange port 82 | TS2 | temperature within burn-out chamber |
| third temperature sensor 144 | exhaust zone 58 of heat exchange chamber 44 | TS3 | temperature within exhaust zone 58 of heat exchange chamber 44 |
| fourth temperature sensor 146 | heat exchanger output conduit 242 | TS4 | temperature of working fluid flowing out of heat exchanger 220 |
| fifth temperature sensor 148 | heat exchanger input conduit 240 | TS5 | temperature of working fluid flowing into heat exchanger 220 |
| sixth temperature sensor 150 | refractory wall (rear wall 364 or side wall(s) 366) | TS6 | temperature of refractory material surrounding combustion chamber 40 |
| seventh temperature sensor 152 | control board 120 | TS7 | operating temperature of electrical components on control board 120 |
| first pressure sensor 160 | heat exchanger output conduit 242 | PS1 | pressure of working fluid flowing out of heat exchanger 220 |
| second pressure sensor 162 | heat exchanger input conduit 240 | PS2 | pressure of working fluid flowing into heat exchanger 220 |
| fan speed sensor 170 | fan 130 | FSS | rotational speed of fan 130 |
| oxygen sensor 172 | exhaust zone 58 of heat exchange chamber 44 | OS | oxygen content of gasses within exhaust zone 58 of heat exchange chamber 44 |

The example biofuel heating system 20 operates in any one of a number of normal operating modes depending upon the state of the heating system 20, the state of the biofuel 22 within the heating system 20, the state of the heat transfer system 34, and the state of the load 24. In particular, the software control program running on the controller 122 operates in any one of a plurality of operating modes depending upon the various inputs to the control system 32.

The following tables describe, for each of a plurality of normal operating modes, the condition that triggers the control program to operate in any one of the normal operating modes, the states of the fan 130, under-fire damper 132, and over-fire damper 134 in these operating modes, and the control variables (sensor signals) used by control program running on the controller 122 when operating in the operating modes.

TABLE B

| Cold Start Mode | |
|---|---|
| Trigger Condition | Control panel; TS4-6 |
| Fan State | Maximum |
| Under-Fire Damper State | Open |
| Over-Fire Damper State | Open |
| Control Variables | TS1-TS7; PS1-2; FSS and OS |

The purpose of the cold start mode is to reduce the time required to achieve the set point temperature when the temperature within the combustion chamber is below a predetermined start threshold value. In particular, the conditions within the furnace assembly 30 when the temperature within the combustion chamber is below the predetermined start threshold value require the biofuel 22 within the combustion chamber 40 to be reignited. To reduce the time required to achieve the set point temperature, the operating parameters of the control system 32 may be set such that the burn obtained in the cold start mode may be less clean than the burn obtained in other modes of operation as will be described below.

TABLE C

| Hot Start Mode | |
|---|---|
| Trigger Condition | Control panel; TS4-6 |
| Fan State | Variable |
| Under-Fire Damper State | Closed |
| Over-Fire Damper State | Open |
| Control Variables | TS1-TS7; PS1-2; FSS and OS |

The purpose of the hot start mode is to reduce the time required to achieve the set point temperature yet maintain a clean burn. In particular, when the temperature within the combustion chamber is above the predetermined start threshold value, the conditions within the furnace assembly 30 allow the temperature of the working fluid within the supply conduit 230 to be quickly brought to the set point temperature while the control system 32 uses operating parameters conducive to a clean burn.

TABLE D

| Steady State Pre-Char Mode | |
|---|---|
| Trigger Condition | TS1; TS2; TS6 |
| Fan State | Variable |
| Under-Fire Damper State | Variable |
| Over-Fire Damper State | Open |
| Control Variables | TS1-TS7; PS1-2; FSS and OS |

When new biofuel 22 such as firewood is initially introduced into the combustion chamber 40, the biofuel is exposed to high temperatures in the absence of significant quantities of oxygen (pyrolysis). During pyrolysis, the newly introduced biofuel produces gas, liquid, and/or particulate byproducts. After the newly introduced biofuel under goes pyrolysis for a sufficient period of time, however, the elimination of the gas and liquid byproducts transforms the biofuel into a solid residue rich in carbon content. At this point, the biofuel may be burned more efficiently for a longer period of time. The example heating system 20 thus operates in the steady state pre-char mode to eliminate gas and liquid byproducts from the biofuel 22.

TABLE E

| Steady State Char Mode | |
|---|---|
| Trigger Condition | TS1; TS2; TS6 |
| Fan State | Variable |
| Under-Fire Damper State | Variable |
| Over-Fire Damper State | Variable (Closed) |
| Control Variables | TS1-TS7; PS1-2; FSS and OS |

After the example heating system 20 operates in the steady-state pre-char mode for a sufficient length of time, the trigger condition associated with steady state char mode is met (cross-over state), indicating that gas and liquid byproducts of the biofuel have been eliminated. When the cross-over state is achieved, the heating system 20 enters the steady state char mode for as long as sufficient biofuel 22 remains within the combustion chamber 40.

TABLE F

| Steady State Fuel Out Mode | |
|---|---|
| Trigger Condition | TS1-6 |
| Fan State | Variable |
| Under-Fire Damper State | Variable |
| Over-Fire Damper State | Variable |
| Control Variables | TS1-TS7; PS1-2; FSS and OS |

When the supply of biofuel 22 within the combustion chamber 40 begins to become depleted, the heating system 20 enters the steady state fuel out mode. In the steady state fuel out mode, the operating parameters of the heating system 20 are adjusted to extend the life of the remaining biofuel 22, possibly at the expense of reduced set point temperature.

TABLE G

| Load Mode | |
|---|---|
| Trigger Condition | load button 180 actuated |
| Fan State | Variable |
| Under-Fire Damper State | Variable |
| Over-Fire Damper State | Variable |
| Control Variables | TS1-TS7; PS1-2; FSS and OS |

The user may cause the biofuel heating system 20 to enter the load mode by pressing the load button 180 on the control panel 124. By actuating the load button 180, the user causes to the control system 32 to load mode initiates either the cold start mode or the hot start mode as described above. In the load mode, the heating system 20 is configured to receive a fresh load of the biofuel 22. The load status lights 182 indicate whether additional biofuel 22 may be placed within the combustion chamber 40.

TABLE H

| Door Open Mode | |
|---|---|
| Trigger Condition | door open button 184 actuated |
| Fan State | Approx. ¾ speed |
| Under-Fire Damper State | CLOSED |
| Over-Fire Damper State | OPEN |
| Control Variables | COUNTDOWN TIMER & TS1-TS7; PS1-2; FSS and OS |

The user may cause the biofuel heating system 20 to enter the door open mode by pressing the door open button 184. In the door open mode, the fan 130 and dampers 132 and 134 are operated substantially to prevent any smoke within the combustion chamber 40 from being drawn out of the furnace assembly 30 when the door assembly 332 is opened. The door open status lights 184 confirm to the user when the door assembly 332 may be opened.

In the various operating modes described above, the example control system 32 controls the under-fire damper 132 and the over-fire damper 134 in either an open (ON) or closed (OFF) configuration. In another form, the control system 32 may, however, be configured to control the dampers 132 and 134 in states between open and closed. The example control system 32 controls the rotational speed of the fan 130 based on a fan control program that implements a second-order differential equation predetermined for the particular configuration of the heating system 20. The fan control program thus regulates the fan speed and the rate of change of fan speed based the control variables listed for each of the various operating modes described above.

In addition to the normal operating modes described above, the example biofuel heating system 20 operates in any one of a number of fault modes depending upon the state of the heating system 20, the state of the heat transfer system 34, and the state of the load 24. The example system status lights 192 indicate whether the heating system is operating normally (NORMAL light energized), whether any of the sensors indicate a potential fault condition (WARNING light energized), or whether any of the sensor indicate a fault condition (ERROR light energized). When one or both of the WARNING light and the ERROR light are energized, the MODE lights indicate which of a plurality of predetermined fault conditions are present detected by the control system 32.

The following Table I contains a list of possible fault or error conditions that may be detected by the example control system 32 and the system parameter(s) associated with each of these error conditions. This list of Error Condition is an example only, and other Error Conditions may be detected by the control system 32. In addition to Error Conditions, the control system 32 may be configured to provide warnings of possible future Error Conditions so that proactive measure may be taken to avoid such possible future Error Conditions.

TABLE I

Error Conditions

| Error Condition | Error Condition Trigger | Error Action(s) |
|---|---|---|
| Stack Temp. Failure | TS3 exceeds predetermined maximum temperature value | UFD: Off<br>OFD: Off<br>Fan: Pulse to purge firebox, then turn Off<br>Control Panel: Energize lights A, B, C, E, and F |
| Pump Failure | No differential pressure as indicated by PS1 and PS2 | UFD: Off<br>OFD: Off<br>Fan: Pulse to purge firebox, then turn Off<br>Control Panel: Energize light A, B, C |
| Working Fluid Excessive | TS2 exceeds predetermined maximum temperature value | UFD: Off<br>OFD: Off<br>Fan: Pulse to purge firebox, then turn Off<br>Control Panel: Energize light D |
| PCB Temp. Excessive | TS7 exceeds predetermined maximum temperature value | UFD: Off<br>OFD: Off<br>Fan: Pulse to purge firebox, then turn Off<br>Control Panel: Energize lights D and E |

TABLE I-continued

Error Conditions

| Error Condition | Error Condition Trigger | Error Action(s) |
|---|---|---|
| Fan Failure | FSS detects improper fan speed, or fan draws no current | Control Panel: Notify Operator |
| Power Failure | loss of electrical power to control board | UFD: Off (Failsafe)<br>OFD: Off (Failsafe)<br>Fan: Off<br>Control Panel: Notify Operator |
| Hot Water Limit | TS4 or TS5 exceeds shut off set point | UFD: Off<br>OFD: Off<br>Fan: Off<br>Control Panel: Notify Operator |

The precise shape, dimensions, and materials selected to form the example heating system 20 depend on the particular set of operating conditions and/or cost limitations for which the heating system 20 is designed. The example furnace assembly 30 is generally rectangular in shape and defines a substantially rectangular combustion chamber 40. The furnace assembly 30, and in particular the combustion chamber 40, may take other shapes and still perform the functions described above. For example, the combustion chamber 40 may be made oval or round and still perform the functions described above. In addition, the aspect ratio of the example furnace assembly 30 is relatively even, but tall and thin or short and wide aspect ratios may be used depending on the particular installation requirements of a particular biofuel heating system.

The example burn-out chamber 42 and the example heat exchange chamber 44 are rectangular with a short wide aspect ratios, but other shapes and aspect ratios may be employed.

The size, shape, and aspect ratios of the chambers 40, 42, and 44 will generally determine the size, shape, and aspect ratio of the overall housing structure 320, but it is possible, for example, to employ a round or oval combustion chamber 40, rectangular burn-out and heat exchange chambers 42 and 44, while providing a generally rectangular housing structure 320.

In this context, the Applicant has determined that, for an example set of operating conditions and cost limitations, the following Table J contains a set of physical characteristics suitable for implementing the principles of the present invention.

TABLE J

Example Physical Characteristics

| Component | Component Characteristics | |
|---|---|---|
| under-fire ports 68 | number | example: 32; first example range: 20-42; second example range: 10-60 |
| | individual cross-sectional area | example: ~0.31 $in^2$; first example range: 0.25 $in^2$-0.40 $in^2$; second example range: 0.20 $in^2$-0.75 $in^2$ |
| | total cross-sectional area | example: ~9.92 $in^2$; first example range: 8-12 $in^2$; second example range: 5-20 $in^2$ |
| | density (number per square inch of bottom wall) | example: 1:0.5 $in^2$; first example range: 1:0.25 $in^2$-1:1 $in^2$; second example range: 1:0.10 $in^2$-1:4 $in^2$ |

TABLE J-continued

| Example Physical Characteristics | | |
|---|---|---|
| Component | | Component Characteristics |
| under-fire inlet 60 | total cross-sectional area | example: 0.785 $in^2$; first example range: 0.6 $in^2$-1.19 $in^2$; second example range: 2 $in^2$-3 $in^2$ |
| over-fire ports 74 | number | example: 14 (7 per side); first example range: 8-24; second example range: 3-36 |
| | individual cross-sectional area | example: ~0.31 $in^2$; first example range: 0.25 $in^2$-0.40 $in^2$; second example range: 0.20 $in^2$-0.75 $in^2$ |
| | total cross-sectional area | example: ~4.34 $in^2$; first example range: 3-8 $in^2$; second example range: 2-12 $in^2$ |
| over-fire inlet 70 | total cross-sectional area | example: 3.14 $in^2$; first example range: 2 $in^2$-3.4 $in^2$-; second example range: 5.8 $in^2$-9.2 $in^2$ |
| over-fire channels 72 | number | example: 2; first example range: 2-4; second example range: 1-9 |
| | individual cross-sectional area | example: example: ~3.0 $in^2$; first example range: 2-5 $in^2$; second example range: 1-10 $in^2$ |
| | total cross-sectional area | example: example: ~6.0 $in^2$; first example range: 4-10 $in^2$; second example range: 2-20 $in^2$ |
| burn-out port 80 | number | example: 2; first example range: 2-3; second example range 1-6 |
| | individual cross-sectional area | example: 32 $in^2$; first example range: 20 $in^2$-38 $in^2$; second example range: 86 $in^2$-118 $in^2$ |
| | total cross-sectional area | example: 64 $in^2$; first example range: 57 $in^2$; second example range: 240 $in^2$-305 $in^2$ |
| heat exch. port 82 | total cross-sectional area | example: 41.3 $in^2$; first example range: 36 $in^2$-47.8 $in^2$; second example range: 78 $in^2$-98 $in^2$ |
| refractory structure 328 | material | ceramic, vermiculite |
| | mass | Example: 620 pounds; first example range: 450 pounds-8050 pounds; second example range: 700 pounds-1,600 pounds. |
| combustion chamber 40 | volume | example: ~16,500 $in^3$; first example range: 12,000 $in^3$-20,000 $in^3$; second example range: 8,000 $in^3$-30,000 $in^3$ |
| | bottom wall area | example: ~610 $in^2$; first example range: 500 $in^2$-700 $in^2$; second example range: 300 $in^2$-1,000 $in^2$ |
| | Side wall area | example: ~500 $in^2$; first example range: 400 $in^2$-600 $in^2$; second example range: 250 $in^2$-1000 $in^2$ |
| burn-out chamber 42 | volume | example: 1,850 $in^3$; first example range: 1,745 $in^3$-2,100 $in^3$; second example range: 3,500 $in^2$-4,400 $in^2$ |
| | length | example: 25 in; first example range: 25 in-35 in; second example range: 40 in-58 in-XX |
| heat exch. chamber 44 | volume | example: 4,050 $in^3$; first example range: 3,000 $in^3$-6,000 $in^3$; second example range: 7,500 $in^3$-10,000 $in^3$ |
| buttresses 370 and 372 | depth | example: ~0.75 in; first example range: 0.5 in-1.25 in; second example range: 0.25 in-3.00 in. |
| | width | example: ~2.0 in; first example range: 1.0 in-4.0 in; second example range: 0.5 in-6.0 in. |
| | length | example: 27 in; first example range: 25 in-30 in; second example range: 28 in 42 in |
| | spacing | example: 7 in intervals; first example range: 5 in-9 in; second example range: 6 in-10 in |
| fan 130 | RPM | example: 5000 rpm; first example range: 200 rpm-5000 rpm; second example range: 180 rpm-3,800 rpm |
| | flow rate range | example: 130 cfm; first example range: 150 cfm-130 cfm; second example range: 0 cfm-280 cfm |
| exhaust air | flow rate range | example: 130 cfm; first example range: 150 cfm-130 cfm; second example range: 0 cfm-280 cfm |
| under-fire air | flow rate range | example: 35 cfm; first example range: 0 cfm-35; second example range: 0 cfm-70 cfm |
| over-fire air | flow rate range | example: 95 cfm; first example range: 0 cfm-95 cfm; second example range: 0 cfm-210 cfm |

Given the foregoing, it should be apparent that the present invention may be embodied in forms other than those described above. The scope of the present invention should be determined by the claims appended hereto and not the following descriptions of examples of the invention.

What is claimed is:

1. A biofuel heating system for converting biofuel to heat energy to be delivered to a working fluid for transferring heat to a load formed by at least one of a domestic hot water system and a domestic space heating system, comprising:

a combustion chamber;

a burn-out chamber;

a burn-out port arranged to allow fluid to flow out of the combustion chamber and into the burn-out chamber;

a heat exchange chamber;

a heat exchange port arranged to allow fluid to flow out of the burn-out chamber and into the heat exchange chamber;

an exhaust port arranged to allow fluid to flow out of the heat exchange chamber;

a heat exchange system arranged at least partly within the heat exchange chamber, where the working fluid is circulated between the heat exchange system and the load;

a fan arranged to cause fluid to flow out of the heat exchange chamber through the exhaust port;

at least one load sensor configured to sense a load operating parameter corresponding to a working fluid temperature of the working fluid after the working fluid returns from the load to the heat exchange system; and a controller for operating the fan based on the load operating parameter such that air flows along a flow path extending through the combustion chamber, through the burn-out port, through the burn-out chamber, through the heat exchange port, through the heat exchange chamber, and out of the exhaust port;

an under-fire damper; and an over-fire damper; whereby the heat exchange system transfers heat energy from air flowing through the heat exchange chamber to the working fluid;

the controller operates in a char mode based at least in part on the load operating parameter, where the biofuel remains within the combustion zone during the char mode, and when the controller operates in the char mode, the controller varies an under-fire damper state of the under-fire damper and varies an over-fire damper state of the over-fire damper.

2. A biofuel heating system as recited in claim 1, further comprising a plurality of system sensors configured to sense at least one system operating parameter, where the controller further operates at least one of the fan, the under-fire damper, and the over-fire damper based on the at least one system operating parameter.

3. A biofuel heating system as recited in claim 2, comprising:

a first temperature sensor for detecting a combustion chamber temperature within the combustion chamber; and a second temperature sensor for detecting a burn-out chamber temperature within the burn-out chamber; wherein the controller operates at least one of the fan, the under-fire damper, and the over-fire damper in a pre-char mode and in the char mode based on the combustion chamber temperature and the burn-out chamber temperature.

4. A biofuel heating system as recited in claim 2, comprising:

a first temperature sensor for detecting a combustion chamber temperature within the combustion chamber;

a second temperature sensor for detecting a burn-out chamber temperature within the burn-out chamber; and a third temperature sensor for detecting an exhaust chamber temperature within the exhaust chamber; wherein the controller operates at least one of the fan, the under-fire damper, and the over-fire damper based on the combustion chamber temperature, the burn-out chamber temperature, and the exhaust chamber temperature.

5. A biofuel heating system as recited in claim 2, in which the at least one load sensor comprises a temperature sensor for detecting the working fluid temperature of the working fluid circulating between the heat exchange system and the load, where the controller operates at least one of the fan, the under-fire damper, and the over-fire damper based on the combustion chamber temperature, the burn-out chamber temperature, the exhaust chamber temperature, and the working fluid temperature.

6. A biofuel heating system as recited in claim 2, in which the controller further operates at least one of the fan, the under-fire damper, and the over-fire damper based on a set point temperature.

7. A biofuel heating system as recited in claim 1, in which the heat exchange system comprises a heat exchanger, a circulation system, and a conditioning system, where the conditioning system is operatively connected between the heat exchanger and the load.

8. A biofuel heating system as recited in claim 2, further comprising at least one external relay adapted to be electrically connected to the load, where the controller further operates the at least one load relay to alter a state of the load based on the at least one system operating parameter.

9. A biofuel heating system as recited in claim 1, in which the controller further operates in a pre-char mode, where, when the controller operates in the pre-char mode, the controller varies an under-fire damper state of the under-fire damper.

10. A biofuel heating system as recited in claim 1, in which the controller further operates in a cold start mode to reduce the time required to achieve a set point temperature when the temperature within the combustion chamber is below a predetermined start threshold value.

11. A biofuel heating system as recited in claim 1, in which the controller further operates in a hot start mode to reduce the time required to achieve a set point temperature while maintaining a clean burn.

12. A biofuel heating system as recited in claim 1, in which the controller further operates in a fuel out mode to extend the burn life of biofuel remaining in the combustion zone.

13. A biofuel heating system as recited in claim 1, in which the controller further operates in a load mode to configure the biofuel heating system to receive a fresh load of biofuel.

14. A biofuel heating system as recited in claim 1, in which the controller further operates in a door open mode to prevent smoke within the combustion chamber from being drawn out of the furnace assembly when a door assembly of the biofuel heating system is opened.

* * * * *